US011588247B2

(12) United States Patent
Lee et al.

(10) Patent No.: US 11,588,247 B2
(45) Date of Patent: Feb. 21, 2023

(54) ANTENNA APPARATUS

(71) Applicant: Samsung Electro-Mechanics Co., Ltd., Suwon-si (KR)

(72) Inventors: Woncheol Lee, Suwon-si (KR); Youngsik Hur, Suwon-si (KR); Wongi Kim, Suwon-si (KR); Jeongki Ryoo, Suwon-si (KR); Nam Ki Kim, Suwon-si (KR); Sungyong An, Suwon-si (KR); Jaemin Keum, Suwon-si (KR); Dongok Ko, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 58 days.

(21) Appl. No.: 17/031,163

(22) Filed: Sep. 24, 2020

(65) Prior Publication Data

US 2022/0013911 A1 Jan. 13, 2022

(30) Foreign Application Priority Data

Jul. 9, 2020 (KR) ..... 10-2020-0084527

(51) Int. Cl.
*H01Q 1/48* (2006.01)
*H01Q 9/04* (2006.01)
*H01Q 5/35* (2015.01)

(52) U.S. Cl.
CPC ..... *H01Q 9/0414* (2013.01); *H01Q 1/48* (2013.01); *H01Q 5/35* (2015.01)

(58) Field of Classification Search
CPC ..... H01Q 9/0414; H01Q 1/48; H01Q 5/35
See application file for complete search history.

(56) References Cited

U.S. PATENT DOCUMENTS 5,153,600 A * 10/1992 Metzler ..... H01Q 9/0414 343/700 MS
6,384,785 B1 5/2002 Kamogawa et al.
(Continued)

FOREIGN PATENT DOCUMENTS

CN 203883119 U * 10/2014
KR 10-2009-0130922 12/2009
KR 10-1844839 B1 4/2018

OTHER PUBLICATIONS

Sharma, Devendra Kumar, et al. "Shared Aperture Dual Band Dual Polarization Microstrip Patch Antenna", *Microwave and Optical Technology Letters*, vol. 55, Issue 4, 2013 (pp. 917-922).
(Continued)

*Primary Examiner* — Dieu Hien T Duong
(74) *Attorney, Agent, or Firm* — NSIP Law

(57) ABSTRACT

An antenna apparatus includes: a first dielectric layer having a first dielectric constant; a first patch antenna pattern disposed in the first dielectric layer; a second dielectric layer having a second dielectric constant; a second patch antenna pattern disposed on the second dielectric layer; a first feed via coupled to the first patch antenna pattern; and a second feed via coupled to the second patch antenna pattern. The first dielectric constant is higher than the second dielectric constant, and a frequency of a signal transmitted/received by the first patch antenna pattern is lower than a frequency of a signal transmitted/received by the second patch antenna pattern.

17 Claims, 12 Drawing Sheets

(56) References Cited

U.S. PATENT DOCUMENTS

| | | | | |
|---|---|---|---|---|
| 2006/0220970 | A1* | 10/2006 | Aminzadeh | H01Q 9/0407 343/700 MS |
| 2011/0279190 | A1* | 11/2011 | Liu | H01P 5/085 333/35 |
| 2012/0139796 | A1 | 6/2012 | Park et al. | |
| 2020/0021019 | A1* | 1/2020 | Rajagopalan | H01Q 9/0414 |

OTHER PUBLICATIONS

Lai, Hau Wah, and Kwai Man Luk. "An L-Probe Fed Patch Antenna Loaded with Multiple Dielectric Layers." *2015 IEEE 4th Asia-Pacific Conference on Antennas and Propagation* (*APCAP*). IEEE, 2015 (pp. 1-2).

* cited by examiner

ANTENNA APPARATUS

CROSS-REFERENCE TO RELATED APPLICATION

This application claims priority to and the benefit under 35 USC 119(a) of Korean Patent Application No. 10-2020-0084527 filed in the Korean Intellectual Property Office on Jul. 9, 2020, the entire contents of which are incorporated herein by reference for all purposes.

BACKGROUND

1. Field

The following description relates to an antenna apparatus.

2. Description of the Background

Data traffic of mobile communication is increasing rapidly every year. Active technology development is in progress to support such a leap in data in real time on a wireless network. For example, Internet of Things (IoT)-based data contents, augmented reality (AR), virtual reality (VR), live VR/AR combined with SNS, autonomous driving, and applications such as SyncView (real-time image transmission from a user's point of view using an ultra-small camera) require communication (e.g., 5G communication, mmWave communication, etc.) to transmit and receive large capacity data.

Therefore, millimeter wave (mmWave) communication including the 5th generation (5G) communication has been actively researched, and research for commercialization/standardization of an antenna apparatus that smoothly implements the mmWave communication is also actively being conducted.

Radio frequency (RF) signals with a high frequency bandwidth (e.g., 24 GHz, 28 GHz, 36 GHz, 39 GHz, 60 GHz, etc.) are easily absorbed and lost in the process of transmission, and thus the quality of communication may drop rapidly. Therefore, an antenna for communication with a high frequency bandwidth requires a different technical approach from the existing antenna technology, and thus the development of special technologies such as a separate power amplifier may be required for securing an antenna gain, integration of an antenna, and effective isotropic radiated power (RFIC).

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

An antenna apparatus that may be easily down-sized while providing a transmitting/receiving mechanism with respect to a plurality of different frequency bandwidths.

An antenna apparatus that may improve a gain of each of a plurality of different frequency bandwidths by improving a degree of isolation between the plurality of different frequency bandwidths.

In one general aspect, an antenna apparatus includes: a first dielectric layer having a first dielectric constant; a first patch antenna pattern disposed in the first dielectric layer; a second dielectric layer having a second dielectric constant;

a second patch antenna pattern disposed on the second dielectric layer; a first feed via coupled to the first patch antenna pattern; and a second feed via coupled to the second patch antenna pattern, wherein the first dielectric constant is higher than the second dielectric constant, and a frequency of a signal transmitted/received by the first patch antenna pattern is lower than a frequency of a signal transmitted/received by the second patch antenna pattern.

The second patch antenna pattern may overlap at least a part of the first patch antenna pattern.

The first patch antenna pattern may be disposed on the second patch antenna pattern.

The first patch antenna pattern may transmit or receive a first RF signal to or from the first feed via, the second patch antenna pattern may transmit or receive a second RF signal to or from the second feed via, and a frequency of the first RF signal may be lower than a frequency of the second RF signal.

The first feed via may include a 1-1 feed via and a 1-2 feed via through which a 1-1 RF signal and a 1-2 RF signal, which are polarized with each other, respectively pass.

The second feed via may include a 2-1 feed via and a 2-2 feed via through which a 2-1 RF signal and a 2-2 RF signal, which are polarized with each other, respectively pass.

The second patch antenna pattern may be provided within the second dielectric layer.

The second patch antenna pattern may have a through-hole, and the first feed via may be disposed within the first dielectric layer and penetrate the through-hole.

The antenna apparatus may further include a ground plane having at least one through-hole.

The first feed via and the second feed via may be connected to an integrated circuit by penetrating the through-hole of the ground plane.

The antenna apparatus may include a connection member that is disposed below the ground plane, and the ground plane may include a plurality of metal layers and a plurality of insulating layers.

In another general aspect, an antenna apparatus includes: a first dielectric layer having a first dielectric constant; a first patch antenna pattern disposed in the first dielectric layer; a second dielectric layer having a second dielectric constant; a second patch antenna pattern disposed on the second dielectric layer; a first feed via coupled to the first patch antenna pattern; a second feed via coupled to the second patch antenna pattern; and shielding vias coupled to the second patch antenna pattern and disposed adjacent to the first feed via. The first dielectric constant is higher than the second dielectric constant, and a frequency of a signal transmitted/received by the first patch antenna pattern is lower than a frequency of a signal transmitted/received by the second patch antenna pattern.

The shielding vias may shield the first feed via from a signal transmitted to/received from the second patch antenna pattern.

A distance between each of the shielding vias and the first feed via may be shorter than a distance between each of the shielding vias and the second feed via.

In another general aspect, an antenna apparatus includes: a first dielectric layer having a first dielectric constant; a first patch antenna pattern disposed on the first dielectric layer and configured to transmit/receive a first signal having a first frequency; a second dielectric layer having a second dielectric constant different than the first dielectric constant; a second patch antenna pattern disposed in the second dielectric layer and configured to transmit/receive a second signal having a second frequency different than the first frequency.

The second patch antenna pattern overlaps at least a portion of the first patch antenna pattern in a propagation direction.

The antenna apparatus may include a ground plane spaced apart from the second patch antenna pattern in the propagation direction and disposed opposite the first patch antenna pattern.

The antenna apparatus may include at least one feed via electrically connecting the first patch antenna pattern to the second patch antenna pattern.

An antenna apparatus for transmitting/receiving different a plurality of frequency bandwidths may be provided and it may be easily down-sized.

Each gain of a plurality of different frequency bandwidths may be improved by improving the degree of isolation between the plurality of different frequency bandwidths.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
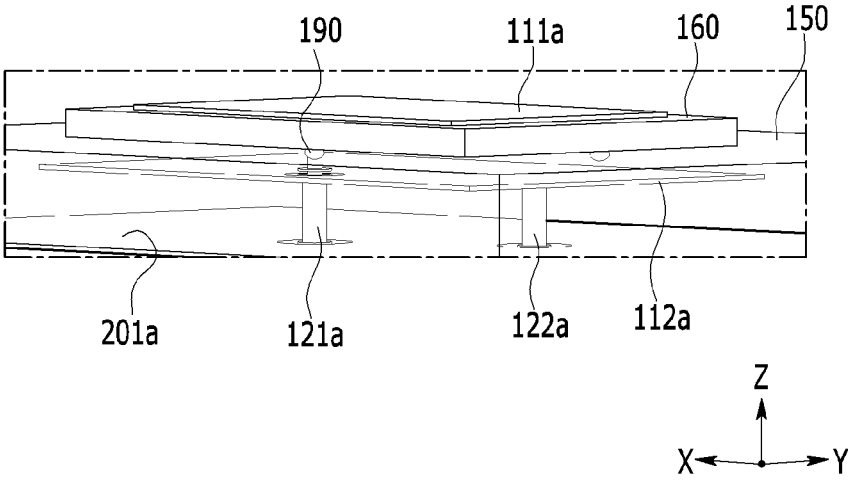
FIG. 1 and FIG. 2A are a perspective view and a side view that schematically illustrate an antenna apparatus according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Throughout the specification, a pattern, a via, a plane, a line, and an electrical connection structure may include a metallic material (e.g., a conductive material such as copper (Cu), aluminum (Al), silver (Ag), tin (Sn), gold (Au), nickel (Ni), lead (Pb), titanium (Ti), or an alloy thereof), and may be formed according to a plating method such as chemical vapor deposition (CVD), physical vapor deposition (PVD), sputtering, a subtractive process, an additive process, a semi-additive process (SAP), a modified semi-additive process (MSAP), and the like, but this is not restrictive.

Throughout the specification, an RF signal includes Wi-Fi (IEEE 802.11 family, etc.), WiMAX (IEEE 802.16 family, etc.), IEEE 802.20, LTE (long term evolution), Ev-DO, HSPA, HSDPA, HSUPA, EDGE, GSM, GPS, GPRS, CDMA, TDMA, DECT, Bluetooth, 3G, 4G, 5G, and any other wireless and wired protocols designated thereafter, but are not limited thereto.

An antenna apparatus according to an example will be described in detail with reference to the accompanying drawings.

Figure 2A:
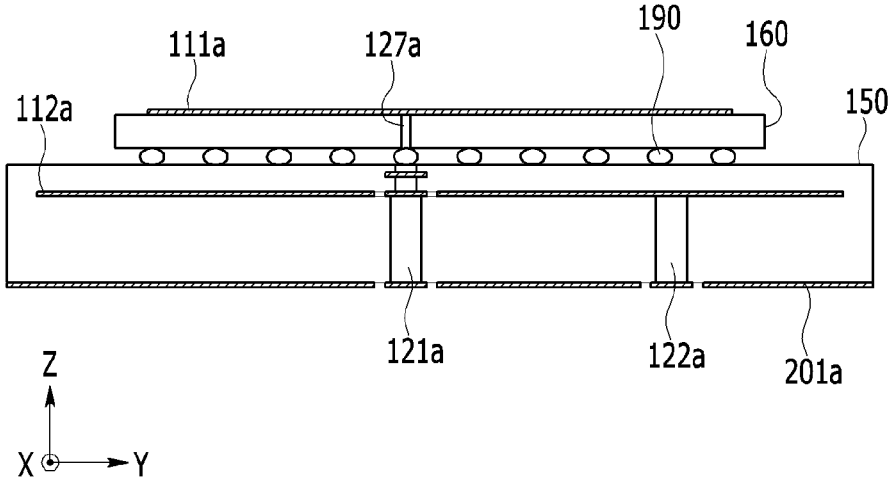

FIG. 1 and FIG. 2A are a perspective view and a side view that schematically illustrate an antenna apparatus.

Referring to FIG. 1 and FIG. 2A, an antenna apparatus includes a first patch antenna pattern 111*a* and a second patch antenna pattern 112*a*, thereby providing transmitting/receiving mechanisms with respect to a plurality of different frequency bandwidths.

In addition, referring to FIG. 1 and FIG. 2A, the antenna apparatus includes a first feed via 121*a*, a second feed via 122*a*, and a ground plane 201*a*.

The first patch antenna pattern 111*a* is connected to one end of the first feed via 121*a*. Accordingly, the first patch antenna pattern 111*a* receives a first radio frequency (RF) signal of a first frequency bandwidth (e.g., 28 GHz) from the first feed via 121*a* to transmit the received first RF signal outside, or receives a first RF signal from outside to provide the received first RF signal to the first feed via 121*a*.

The second patch antenna pattern 112*a* is connected to one end of the second feed via 122*a*. Accordingly, the second patch antenna pattern 112*a* receives a second RF signal of a second frequency bandwidth (e.g., 39 GHz) from the second feed via 122*a* to transmit the received second RF signal outside, or receives a second RF signal from outside to provide the received second RF signal to the second feed via 122*a*.

The first and second patch antenna patterns 111*a* and 112*a* may intensively receive energy corresponding to the first and second signals by resonating with respect to the first and second frequency bandwidths and then emit the energy to the outside.

The ground plane 201*a* may reflect the first RF signal and the second RF signal radiated toward the ground plane 201*a* among the first and second RF signals that are radiated from the first and second patch antenna patterns 111*a* and 112*a*, and thus radiation patterns of the first and second patch antenna patterns 111*a* and 112*a* may be concentrated to a specific direction (e.g., z-axis direction). Accordingly, the gains of the first and second patch antenna patterns 111*a* and 112*a* may be improved.

Resonance of the first and second patch antenna patterns 111*a* and 112*a* may be generated based on a resonance frequency according to a combination of inductance and capacitance corresponding to the first and second patch antenna patterns 111*a* and 112*a* and a structure at the periphery of the first and second patch antenna patterns 111*a* and 112*a*.

A size of an upper side and/or a bottom side of each of the first patch antenna pattern 111*a* and the second patch antenna pattern 112*a* may affect the resonance frequency. For example, the size of the upper side and/or the bottom side of each of the first patch antenna pattern 111*a* and the second patch antenna pattern 112*a* may be dependent on a first wavelength and a second wavelength that respectively correspond to the first frequency and the second frequency.

The first patch antenna pattern 111*a* and the second patch antenna pattern 112*a* may be at least partially overlapped with each other in a vertical direction (e.g., the z-axis direction). Accordingly, the size of the antenna apparatus in a horizontal direction (e.g., the x-axis direction and/or y-axis direction) may be significantly reduced, and thus the antenna apparatus may be easily down-sized overall.

When the first patch antenna pattern 111*a* and the second patch antenna pattern 112*a* are positioned within a dielectric layer having a relatively low dielectric constant, the entire size of the antenna is determined according to the size of the first patch antenna pattern 111*a* since the first patch antenna pattern 111*a* is larger than the second patch antenna pattern 112*a* in size.

However, referring to FIG. 1 and FIG. 2A, the first patch antenna pattern 111*a* and the second patch antenna pattern 112*a* are disposed on or within dielectric layers, each having a different dielectric material. For example, the first patch antenna pattern 111*a* is disposed in a first dielectric layer 160 having a first dielectric constant and the second patch antenna pattern 112*a* is disposed within a second dielectric layer 150 having a second dielectric constant, and the first dielectric constant is higher than the second dielectric constant. Accordingly, an electrical length of the first patch antenna pattern 111*a* may be shortened due to the first dielectric layer 160 having the relatively higher first dielectric constant, and thus the size of the first patch antenna pattern 111*a* may be reduced and the overall size of the antenna may be more reduced compared to the case in which the first patch antenna pattern 111*a* and the second patch antenna pattern 112*a* are disposed within dielectric layers having relatively lower dielectric constants.

The first dielectric layer 160 having the first dielectric constant has a single layered structure or a multi-layered structure. When the first dielectric layer 160 having the first dielectric constant has the multi-layered structure, a more sufficient bandwidth of the first patch antenna pattern 111*a* may be assured. For example, since there is a limit in an increase of the thickness of the single layer, a distance between the first patch antenna pattern 111*a* and the ground plane 201*a* is increased when a plurality of layers is used, and accordingly, a bandwidth may be expanded. In addition, in the multi-layered structure, when the first patch antenna pattern 111*a* is indirectly fed by coupling feeding, a resonance may be formed in the first dielectric layer 160 having the first dielectric constant to increase a bandwidth and design freedom.

The second dielectric layer 150 having the second dielectric constant has a single-layered structure or a multi-layered structure. When the second dielectric layer 150 having the second dielectric constant has the multi-layered structure, a more sufficient bandwidth of the second patch antenna pattern 112*a* may be assured. For example, since there is a limit in an increase of the thickness of the single layer, a distance between the second patch antenna pattern 112*a* and the ground plane 201*a* is increased when a plurality of layers is used, and accordingly, a bandwidth may be expanded. In addition, in the multi-layered structure, when the second patch antenna pattern 112*a* is indirectly electrically fed by coupling feeding, a resonance may be formed in the second dielectric layer 150 having the second dielectric constant to increase a bandwidth and design freedom.

The first patch antenna pattern 111*a* and the first feed via 121*a* may be connected with each other with an electrical connection structure body 190. For example, the electrical connection structure body 190 may have a structure of a solder ball, a pin, a land, a pad, and the like.

The first feed via 121*a* and the second feed via 122*a* are disposed to penetrate at least one through-hole of the ground plane 201*a*. Accordingly, one end of each of the first feed via 121*a* and the second feed via 122*a* is disposed at an upper side of the ground plane 201*a*, and the other end of each of the first feed via 121*a* and the second feed via 122*a* is disposed in a lower side of the ground plane 201*a*. Here, the other end of the first feed via 121*a* and the other end of the second feed via 122*a* are connected to an integrated circuit (IC) and thus may provide the first and second RF signals to the IC or receive the first and second RF signals from the IC. The degree of electromagnetic isolation between the first and second patch antenna patterns 111*a* and 112*a* and the IC may be improved by the ground plane 201*a*.

Energy loss in the antenna apparatuses of the first and second RF signals may be reduced as an electrical length from the first and second patch antenna patterns 111*a* and 112*a* to the IC decreases. Since a length in the vertical direction (e.g., the z-axis direction) between the first and second first patch antenna patterns 111*a* and 112*a* and the IC is relatively short, the first feed via 121*a* and the second feed via 122*a* may easily reduce the electrical distance between the first and second patch antenna patterns 111*a* and 112*a* and the IC.

When the first patch antenna pattern 111*a* and the second patch antenna pattern 112*a* are at least partially overlapped with each other, the first feed via 121*a* may be disposed to penetrate the second patch antenna pattern 112*a* so as to be electrically connected to the first patch antenna pattern 111*a*.

Accordingly, the energy loss in the antenna apparatuses of the first and second RF signals may be reduced, and a connection point of the first feed via 121*a* and the second feed via 122*a* in the first patch antenna pattern 111*a* and the second patch antenna pattern 112*a* may be more freely designed.

Here, the connection point of the first feed via 121*a* and the second feed via 122*a* may affect the transmission line impedance in terms of the first and second RF signals. The transmission line impedance may reduce reflection during a process for providing the first and second RF signals as it closely matches a specific impedance (e.g., 50 ohms), and thus when the design freedom is high at the connection points of the first feed via 121*a* and the second feed via 122*a*, the gains of the first and second patch antenna patterns 111*a* and 112*a* may be more easily improved.

Referring to FIG. 2A, the first patch antenna pattern 111*a* is connected to a third feed via 127*a* positioned inside the first dielectric layer 160 having the first dielectric constant, and connected to the first feed via 121*a* and the electrical connection structure body 190. Accordingly, the first patch antenna pattern 111*a* may transmit and receive the RF signal.

Figure 2B:
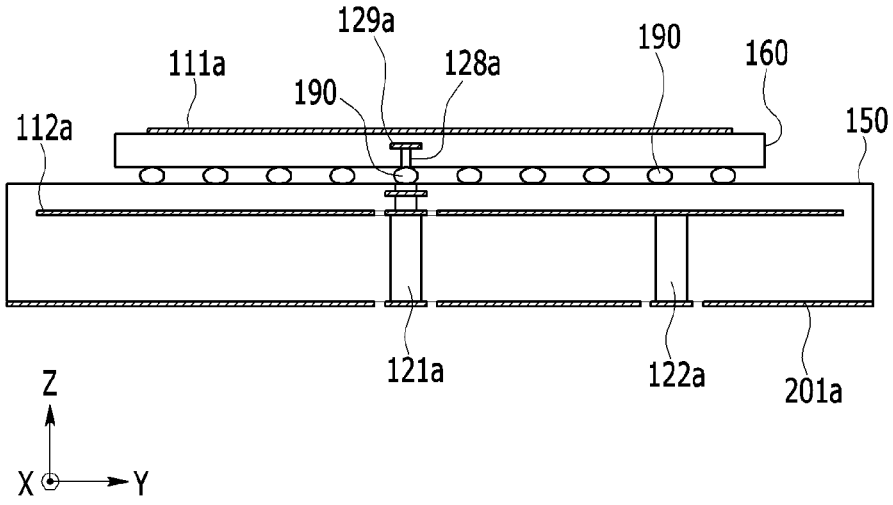
FIG. 2B is a side view that schematically illustrates the antenna apparatus according to an example.

FIG. 2B is a schematic side view of the antenna apparatus according to an example. A description of repeated elements may be omitted.

Referring to FIG. 2B, the first patch antenna pattern 111*a* is disposed separate from a fourth feed via 128*a* and a feed pattern 129*a* positioned inside the first dielectric layer 160 having the first dielectric constant. The fourth feed via 128*a* and the feed pattern 129*a* are connected to each other, and the fourth feed via 128*a* is connected with the electrical connection structure body 190. The feed pattern 129*a* expands substantially in parallel with the first patch antenna pattern 111*a*, and may have various planar shapes such as a polygon, a circle, and the like. When an electrical signal is transmitted to the fourth feed via 128*a* from an electrical element, the feed pattern 129*a* connected to the feed via 128*a* that has received the electrical signal, and the first patch antenna pattern 111*a* are coupled with each other such that the first patch antenna pattern 111*a* is electrically fed by the coupling feeding. The electrically-fed first patch antenna pattern 111*a* may transmit and receive the RF signal to and from the ground plane 201*a* by the coupling.

Figure 3:
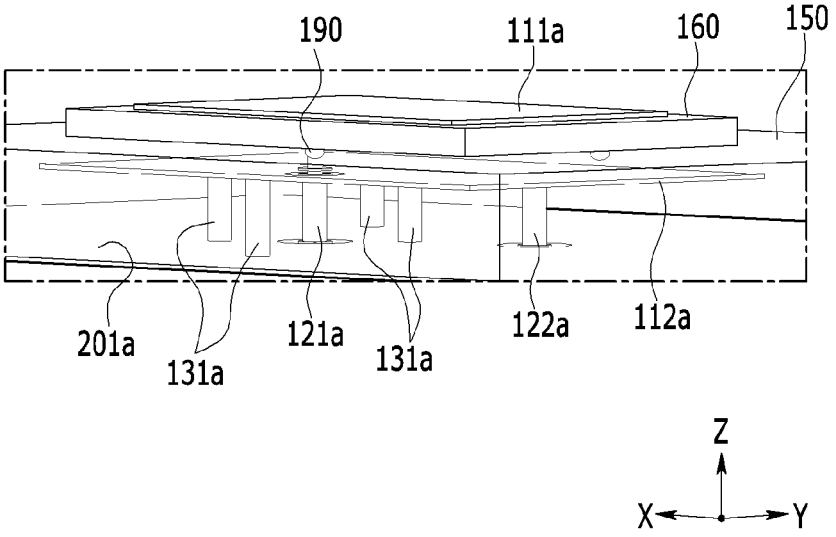
FIG. 3 and FIG. 4A are a perspective view and a side view that schematically illustrate an antenna apparatus according to an example.
Figure 4A:
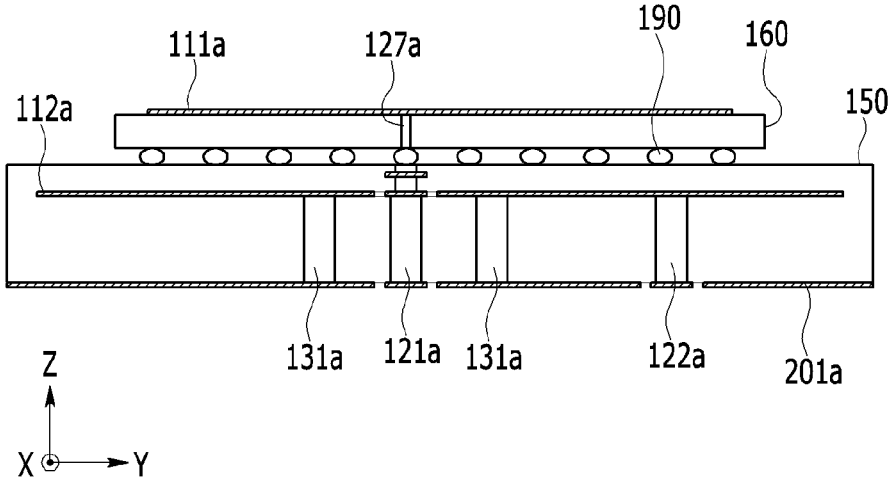

FIG. 3 and FIG. 4A are a perspective view and a side view that schematically illustrate an antenna apparatus according to an example. A description of repeated elements may be omitted.

Referring to FIG. 3 and FIG. 4A, an antenna apparatus includes a first patch antenna pattern 111*a* and a second patch antenna pattern 112*a*, and a plurality of shielding vias 131*a* that are disposed close to the first feed via 121*a*. For example, the plurality of shielding vias 131*a* may be arranged to surround the first feed via 121*a*. A distance between the plurality of shielding vias 131*a* and the first feed via 121*a* is shorter than a distance between the plurality of shielding vias 131*a* and the second feed via 122*a*. The plurality of shielding vias 131*a* may be disposed to connect the second patch antenna pattern 112*a* and the ground plane 201*a*. The plurality of shielding vias 131*a* may shield the first feed via 121*a* from a signal transmitted to and received from the second patch antenna pattern 112*a*.

The first feed via 121*a* may be affected by radiation of the second RF signal concentrated to the second patch antenna pattern 112*a* because it is disposed to penetrate the second patch antenna pattern 112*a*, and the plurality of shielding vias 131*a* may reduce such an influence to thereby reduce deterioration of the gain of each of the first patch antenna pattern 111*a* and the second patch antenna pattern 112*a*.

A second RF signal radiated toward the first feed via 121*a* among the second RF signals radiated from the second patch antenna pattern 112*a* may be reflected by the plurality of shielding vias 131*a*, and therefore the degree of electromagnetic isolation between the gains of the first patch antenna pattern 111*a* and the second patch antenna pattern 112*a* may be improved.

The number and the width of the plurality of shielding vias 131*a* are not particularly restrictive. When a gap of a space between the plurality of shielding vias 131*a* is shorter than a specific length (e.g., a length depending on a second wavelength of the second RF signal), the second RF signal may not substantially pass through the space between the plurality of shielding vias 131*a*. Accordingly, the degree of electromagnetic isolation between the first and second RF signals may be more improved.

Since a through-hole and/or the plurality of shielding vias 131*a* of the second patch antenna pattern 112*a* may act as an obstacle with respect to a surface current corresponding to the second RF signal, a negative affect with respect to the second RF signal may be reduced when being closer toward the center of the second patch antenna pattern 112*a*.

In addition, since the through-hole or the plurality of shielding vias 131*a* of the second patch antenna pattern 112*a* may act as an obstacle with respect to a surface current corresponding to the second RF signal, a negative affect with respect to the second RF signal may be reduced as an electrical distance between the second feed via 122*a* to which the second RF signal is transmitted, and the through-hole and/or the plurality of shielding vias 131*a*, is increased.

Referring to FIG. 4A, the first patch antenna pattern 111*a* is connected with a third feed via 127*a* that is disposed inside a first dielectric layer 160 having a first dielectric constant, and is connected with the first feed via 121*a* and an electrical connection structure body 190. Accordingly, the first patch antenna pattern 111*a* may transmit and receive RF signals.

Figure 4B:
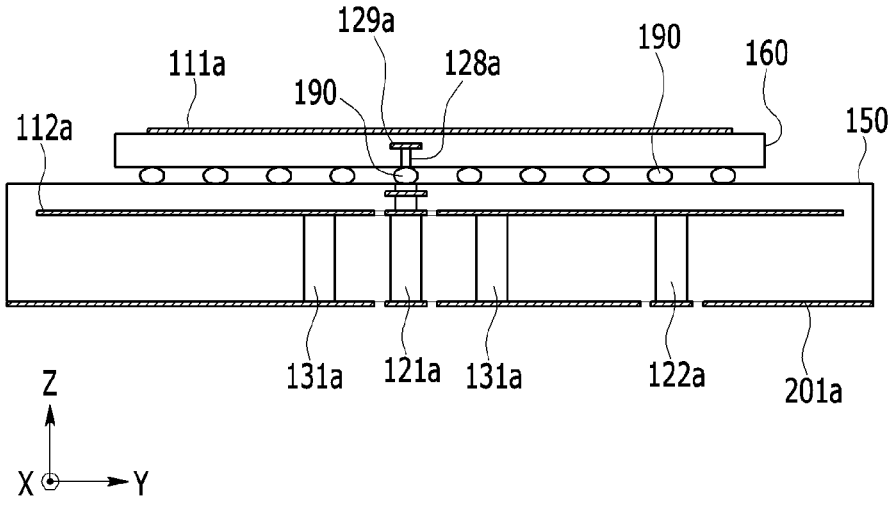
FIG. 4B is a schematic side view of the antenna apparatus according to an example.

FIG. 4B is a schematic side view of the antenna apparatus according to an example. A description of repeated elements may be omitted.

Referring to FIG. 4B, the first patch antenna pattern 111*a* is connected with a fourth feed via 128*a* and a feed pattern 129*a* that are disposed inside the first dielectric layer 160 having the first dielectric constant. The fourth feed via 128*a* and the feed pattern 129*a* are connected to each other, and the fourth feed via 128*a* is connected with the electrical connection structure body 190. The feed pattern 129*a* expands substantially in parallel with the first patch antenna pattern 111*a*, and may have various planar shapes such as a polygon, a circle, and the like. When an electrical signal is transmitted to the fourth feed via 128*a* from an electrical element, the feed pattern 129*a* and the first patch antenna pattern 111*a* connected to the feed via 128*a* that has received the electrical signal are coupled and thus the first patch antenna pattern 111*a* is fed by coupling feeding. The fed first patch antenna pattern 111*a* may transmit and receive the RF signal to and from the ground plane 201*a* through coupling.

Figure 5:
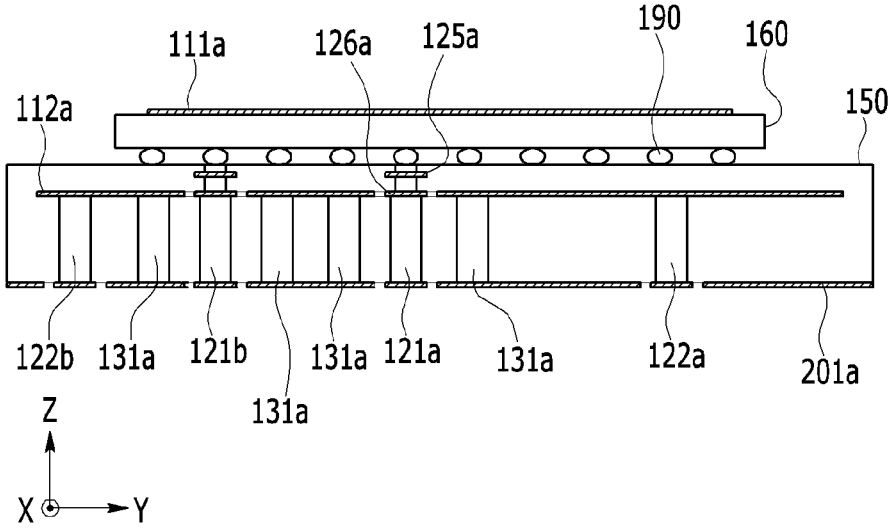
FIG. 5 and FIG. 6 are a side view and a top plan view that schematically illustrate an antenna apparatus according to an example.
Figure 6:
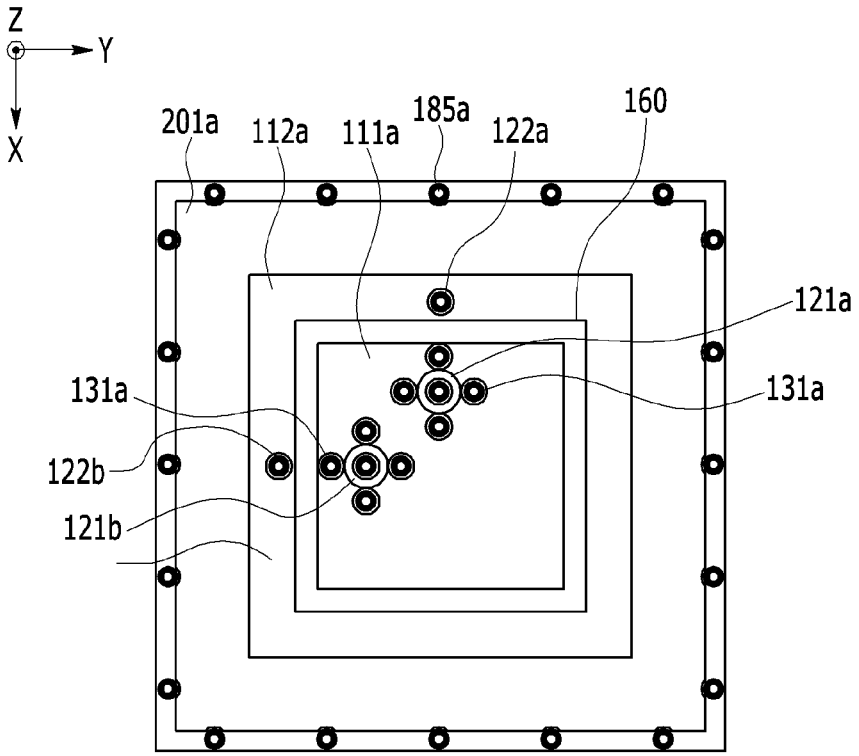

FIG. 5 and FIG. 6 are a side view and a top plan view that schematically illustrate an antenna apparatus according to an example. A description of repeated elements may be omitted.

Referring to FIG. 5 and FIG. 6, an antenna apparatus includes two first feed vias 121*a* and 121*b* and two second feed vias 122*a* and 122*b*, and thus it is possible to transmit/receive a plurality of polarized signals having different phases.

The first feed vias 121*a* and 121*b* may include a 1-1 feed via 121*a* and a 1-2 feed via 121*b* through which a 1-1 RF signal and a 1-2 RF signal, which are polarized with each other, respectively pass. The second feed vias 122*a* and 122*b* may include a 2-1 feed via 122*a* and a 2-2 feed via 122*b* through which a 2-1 RF signal and a 2-2 RF signal, which are polarized with each other, respectively pass.

The first patch antenna pattern 111*a* and the second patch antenna pattern 112*a* may respectively transmit and receive a plurality of RF signals, and the plurality of RF signals may be a plurality of carrier signals, each including different data, and thus a data transmitting/receiving rate of each of the first patch antenna pattern 111*a* and the second patch antenna pattern 112*a* may be double-improved depending on transmitting/receiving of the plurality of RF signals.

For example, the 1-1 RF signal and the 1-2 RF signal may reduce interference with respect to each other by having different phases (e.g., a phase difference of 90 degrees or 180 degrees), and the 2-1 RF signal and the 2-2 RF signal may reduce interference with each other by having different phases (e.g., a phase difference of 90 degrees or 180 degrees).

For example, the 1-1 RF signal and the 2-1 RF signal form electric fields and magnetic fields for an x-axis direction and a y-axis direction, which are perpendicular to a propagation direction (e.g. a z-axis direction), and the 1-2 RF signal and the 2-2 RF signal form electric fields and magnetic fields for the x-axis direction and the y-axis direction such that polarization between RF signals may be implemented. In the first patch antenna pattern 111*a* and the second patch antenna pattern 112*a*, the surface current corresponding to the 1-1 RF signal and the 2-1 RF signal and the surface current corresponding to the 1-2 RF signal and the 2-2 RF signal may flow to be perpendicular to each other.

The first 1-1 feed via 121*a* and the second 2-1 feed via 122*a* may be connected to each other and adjacent to an edge in one direction (e.g., the y-axis direction) in the first patch antenna pattern 111*a* and the second patch antenna pattern 112*a*, and the 1-2 feed via 121*b* and the 2-2 feed via 122*b* may be connected to each other and adjacent to an edge in the other direction (e.g., the x-axis direction) in the first patch antenna pattern 111*a* and the second patch antenna pattern 112*a*, but detailed connection points may be configured differently depending on designs.

Referring to FIG. 5, the first feed via 121*a* may include support patterns 125*a* and 126*a* having widths that are wider than the width of the first feed via 121*a*. A process error may occur in alignment during multi-layered PCB manufacturing, and the support patterns 125*a* and 126*a* have the wider widths than the width of the first feed via 121*a*, thereby preventing occurrence of a short-circuit in the multi-layered PCB manufacturing. However, the support patterns 125*a* and 126*a* may be omitted depending on designs.

Referring to FIG. 6, the antenna apparatus may further include peripheral coupling members 185*a* that are arranged to surround at least a part of the first patch antenna pattern 111*a* and the second patch antenna pattern 112*a*. The peripheral coupling members 185*a* may be connected to the ground plane 201*a*. Accordingly, the antenna apparatus may further improve the electromagnetic isolation with respect to an adjacent antenna apparatus. For example, the peripheral coupling members 185*a* may be formed of a combination of horizontal direction patterns and vertical direction vias, but this is not restrictive. In addition, the peripheral coupling members 185*a* may be omitted depending on design.

Figure 7:
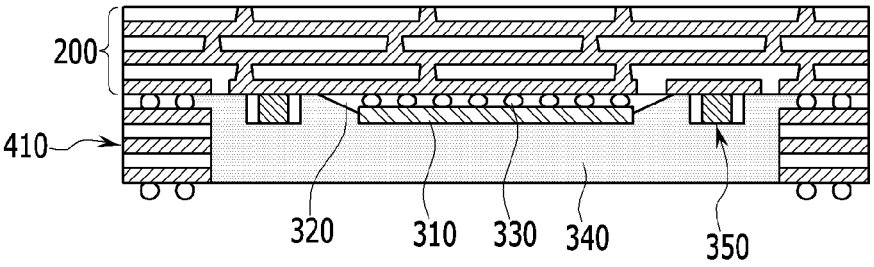
FIG. 7 is a side view that schematically illustrates a structure of a lower side of the antenna apparatus according to an example.

FIG. 7 is a side view that schematically illustrates a structure of a lower side of the antenna apparatus according to an example.

Referring to FIG. 7, the antenna apparatus may include at least a part of a connection member 200, an IC 310, an adhesive member 320, an electrical connection structure 330, an encapsulant 340, a manual part 350, and a core member 410.

The connection member 200 may have a structure in which a plurality of metal layers and a plurality of insulating layers having a previously designed pattern such as a printed circuit board (PCB) are stacked.

The IC 310 may be disposed below the connection member 200. The IC 310 may transmit or receive an RF signal by being connected to a wire of the connection member 200, and may receive the ground by being connected to a ground plane of the connection member 200. For example, the IC 310 may generate a signal converted by performing at least some of frequency conversion, amplification, filtering, phase control, and power generation.

The adhesive member 320 may bond the IC 310 and the connection member 200 to each other.

The electrical connection structure 330 may connect the IC 310 and the connection member 200. For example, the electrical connection structure 330 may have a structure such as a solder ball, a pin, a land, or a pad. The electrical connection structure 330 has a lower melting point than the wiring and ground plane of the connection member 200, and thus the IC 310 and the connection member 200 may be connected through a predetermined process using the lower melting point.

The encapsulant 340 may seal at least part of the IC 310, and improve heat dissipation performance and impact protection performance of the IC 310. For example, the encapsulant 340 may be implemented as a photoimageable encapsulant (PIE), an Ajinomoto build-up film (ABF), an epoxy molding compound (EMC), and the like.

The manual part 350 may be disposed on the bottom surface of the connection member 200, and may be connected to the wire and/or the ground plane of the connection member 200 through the electrical connection structure 330. For example, the manual part 350 may include a capacitor (e.g., a multi-layer ceramic capacitor, MLCC), an inductor, and a chip resistor.

The core member 410 may be disposed below the connection member 200, and may be connected to the connection member to receive an intermediate frequency (IF) signal or a base band signal from the outside and transmit the received signal to the 10310, or receive the IF signal or the base band signal from the IC 310 and transmit the received signal to the outside. Here, a frequency (e.g.: 24 GHz, 28 GHz, 36 GHz, 39 GHz, 60 GHz, and the like) of the RD signal is higher than a frequency (e.g.: 2 GHz, 5 GHz, and 10 GHz, and the like) of the RF signal.

For example, the core member 410 may transmit the IF signal or the base band signal to the IC 310 or receive the signals from the IC 310 through a wire that may be included in the IC ground plane of the connection member 200. Since the ground plane of the connection member 200 is disposed between the IC ground plane and the wire, the IF signal or the base band signal may be electrically separated from the RF signal in the antenna apparatus.

Figure 8:
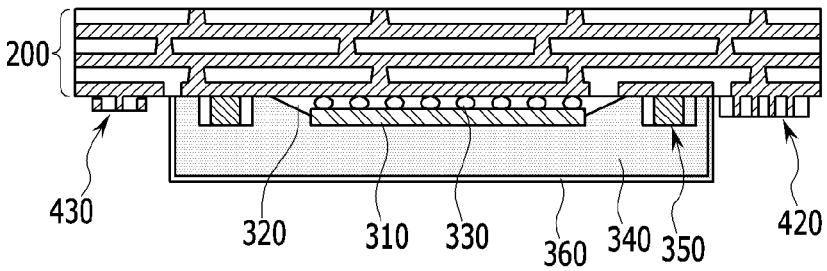
FIG. 8 is a side view that schematically illustrates a lower side structure of an antenna apparatus according to an example.

FIG. 8 is a side view that schematically illustrates a lower side structure of an antenna apparatus according to an example. A description of repeated elements may be omitted.

Referring to FIG. 8, the antenna apparatus may include at least a part of a shielding member 360, a connector 420, and a chip antenna 430.

The shielding member 360 is disposed below the connection member 200 and thus may confine the IC 310 and the encapsulant 340, together with the connection member 200. For example, the shielding member 360 may conformably or compartmentally shield the IC 310, the manual part 350, and the encapsulant 340. For example, the shielding member 360 has one side formed in the shape of an opened hexahedron, and may form a receiving space of a hexahedron through combination with the connection member 200. The shielding member 360 is formed of a material having high conductivity such as copper, and thus may have a short skin depth and may be connected to the ground plane of the connection member 200. Thus, the shielding member 360 may reduce an electromagnetic noise that the IC 310 and the manual part 350 may receive. However, the encapsulant 340 may be omitted depending on design.

The connector 420 may have a connection structure of a cable (e.g., a coaxial cable and a flexible PCB) and may be connected to the IC ground plane, and may play a similar role to a sub-substrate. The connector 420 may receive the IF signal, the baseband signal, and/or power from the cable, or supply the IF signal and/or the baseband signal to the cable.

The chip antenna 430 may transmit or receive the RF signal by assisting the antenna apparatus according to the exemplary embodiment. For example, the chip antenna 430 may include a dielectric material block having a dielectric constant greater than that of the insulating layer, and a plurality of electrodes disposed on both sides of the dielectric material block. One of the plurality of electrodes may be connected to a wire of the connection member 200, and the other may be connected to the ground plane of the connection member 200.

Figure 9:
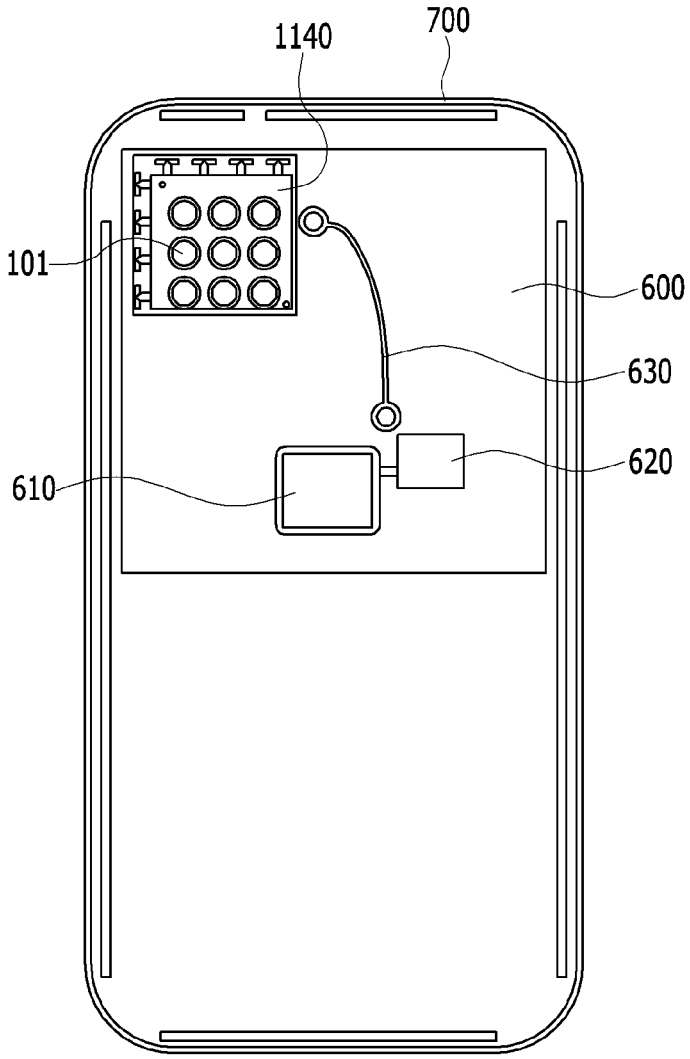
FIG. 9 is a top plan view of alignment of an antenna apparatus in an electronic device according to an example.

FIG. 9 is a top plan view of alignment of an antenna apparatus in an electronic device according to an example. A description of repeated elements may be omitted.

Referring to FIG. 9, an antenna apparatus including a patch antenna pattern 101 may be disposed adjacent to a side boundary of an electronic device 700 on a set substrate 600 of the electronic device 700.

The electronic device 700 may be a smart phone, a personal digital assistant, a digital video camera, a digital still camera, a network system, a computer, a monitor, a tablet, a laptop, a netbook, a television, a video game, a smart watch, an automotive device, and the like, and this is not restrictive.

A communication module 610 and a baseband circuit 620 may be further disposed on the set substrate 600. The antenna apparatus may be connected to the communication module 610 and/or the baseband circuit 620 through a coaxial cable 630.

The communication module 610 may include at least a part of a memory chip such as a volatile memory (e.g., a DRAM), a non-volatile memory (e.g., a ROM), a flash memory, and the like, an application processor chip such as a central processor (e.g., a CPU), a graphics controller (e.g., a GPU), a digital signal processor, an encryption processor, a microprocessor, a microcontroller, and the like, and a logic chip such as an analog-digital converter, an application-specific IC (ASIC), and the like.

The baseband circuit 620 may generate a base signal by performing analog-digital conversion, amplification for an analog signal, and filtering and frequency conversion. The base signal input/output from the baseband circuit 620 may be transmitted to the antenna apparatus through a cable.

For example, the base signal may be transmitted to the IC through an electrical connection structure body and a core via and wiring. The IC may convert the base signal to an RF signal in a millimeter wave (mmWave) band.

A dielectric layer 1140 may be filled in an area where a pattern, a via, a plane, a line, and an electrical connection structure are not disposed in the antenna apparatus.

For example, the dielectric layer 1140 may be formed of a thermosetting resin such as FR4, a liquid crystal polymer (LCP), a low temperature co-fired ceramic (LTCC), an epoxy resin, and the like, a resin impregnated together with inorganic fillers into core materials such as glass fiber, glass cloth, class fabric, and the like, a prepreg, an Ajinomoto build-up film (ABF), FR-4, bismaleimide triazine (BT), a photoimageable dielectric (PID) resin, a general copper clad laminate (CCL), or a glass or ceramic-based insulator, and the like.

Figure 10:
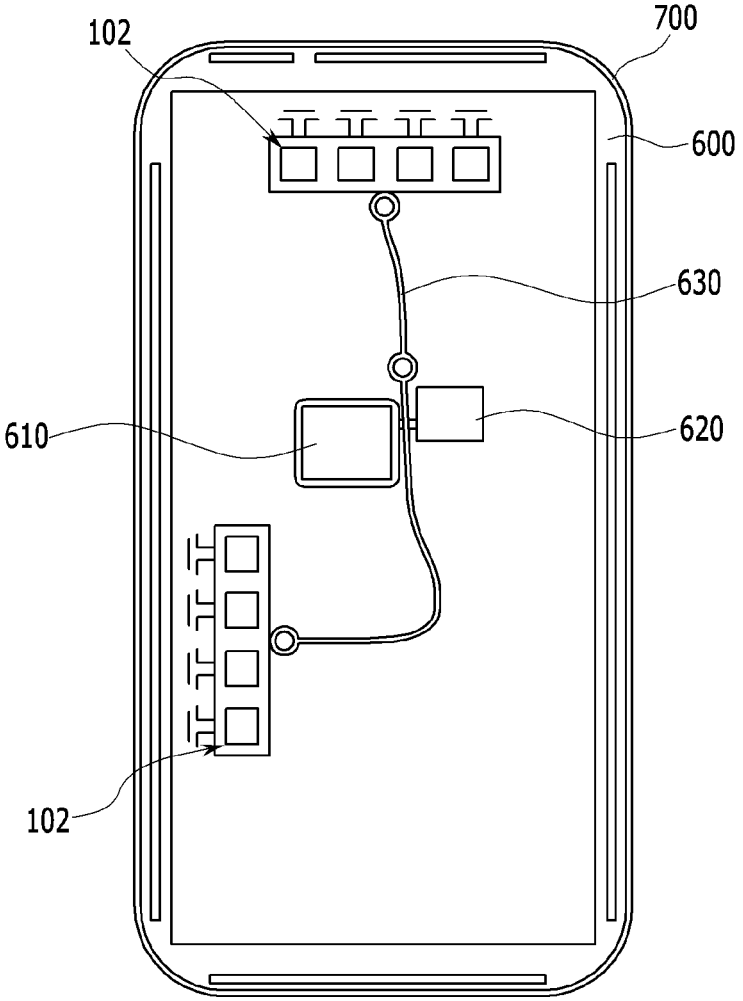
FIG. 10 is a top plan view that shows an alignment of the antenna apparatus in the electronic device according to an example.

FIG. 10 is a top plan view that exemplarily shows an alignment of the antenna apparatus in the electronic device according to an example. A description of repeated elements may be omitted.

Referring to FIG. 10, a plurality of antenna apparatuses, each including a patch antenna pattern 102, may be disposed adjacent to a center of sides of a polygonal electronic device 700 on the set substrate 600 of the electronic device 700, and a communication module 610 and a baseband circuit 620 may be further disposed on the set substrate 600. The antenna apparatus and antenna module may be connected to the communication module 610 and/or baseband circuit 620 through a coaxial cable 630.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus comprising:
- a first dielectric layer having a first dielectric constant;
- a first patch antenna pattern disposed in the first dielectric layer;
- a second dielectric layer having a second dielectric constant;
- a second patch antenna pattern disposed on the second dielectric layer;
- a first feed via coupled to the first patch antenna pattern;
- a second feed via coupled to the second patch antenna pattern; and
- shielding vias coupled to the second patch antenna pattern and disposed adjacent to the first feed via,
- wherein the first dielectric constant is higher than the second dielectric constant,
- wherein a frequency of a signal transmitted/received by the first patch antenna pattern is lower than a frequency of a signal transmitted/received by the second patch antenna pattern,
- wherein a size of the first patch antenna pattern is smaller than a size of the second patch antenna pattern, and
- wherein all of the shielding vias are disposed more adjacent to the first feed via than the second feed via.

2. The antenna apparatus of claim 1, wherein the second patch antenna pattern overlaps at least a part of the first patch antenna pattern.

3. The antenna apparatus of claim 2, wherein the first patch antenna pattern is disposed on the second patch antenna pattern.

4. The antenna apparatus of claim 1, wherein the first patch antenna pattern is configured to transmit or receive a first RF signal to or from the first feed via, the second patch antenna pattern is configured to transmit or receive a second RF signal to or from the second feed via, and a frequency of the first RF signal is lower than a frequency of the second RF signal.

5. The antenna apparatus of claim 1, wherein the first feed via comprises a 1-1 feed via and a 1-2 feed via through which a 1-1 RF signal and a 1-2 RF signal, which are polarized with each other, respectively pass.

6. The antenna apparatus of claim 5, wherein the second feed via comprises a 2-1 feed via and a 2-2 feed via through which a 2-1 RF signal and a 2-2 RF signal, which are polarized with each other, respectively pass.

7. The antenna apparatus of claim 1, wherein the second patch antenna pattern is disposed within the second dielectric layer.

8. The antenna apparatus of claim 7, wherein the second patch antenna pattern has a through-hole, and the first feed via is disposed within the first dielectric layer and penetrates the through-hole.

9. The antenna apparatus of claim 1, further comprising a ground plane having at least one through-hole.

10. The antenna apparatus of claim 9, wherein the first feed via and the second feed via are connected to an integrated circuit by penetrating the through-hole of the ground plane.

11. The antenna apparatus of claim 10, further comprising a connection member disposed below the ground plane, and comprising a plurality of metal layers and a plurality of insulating layers.

12. An antenna apparatus comprising:
- a first dielectric layer having a first dielectric constant;
- a first patch antenna pattern disposed in the first dielectric layer;
- a second dielectric layer having a second dielectric constant;
- a second patch antenna pattern disposed on the second dielectric layer;
- a first feed via coupled to the first patch antenna pattern;
- a second feed via coupled to the second patch antenna pattern; and
- shielding vias coupled to the second patch antenna pattern and disposed adjacent to the first feed via,
- wherein the first dielectric constant is higher than the second dielectric constant,
- wherein a frequency of a signal transmitted/received by the first patch antenna pattern is lower than a frequency of a signal transmitted/received by the second patch antenna pattern, and
- wherein all of the shielding vias are disposed more adjacent to the first feed via than the second feed via.

13. The antenna apparatus of claim 12, wherein the shielding vias are configured to shield the first feed via from a signal transmitted to/received from the second patch antenna pattern.

14. The antenna apparatus of claim 12, wherein the second patch antenna pattern is disposed within the second dielectric layer.

15. The antenna apparatus of claim 14, wherein the first feed via is disposed within the first dielectric layer and penetrates a through-hole in the second patch antenna pattern.

16. An antenna apparatus comprising:
- a first dielectric layer having a first dielectric constant;
- a first patch antenna pattern disposed on the first dielectric layer and configured to transmit/receive a first signal having a first frequency;
- a second dielectric layer having a second dielectric constant lower than the first dielectric constant;

a first feed via coupled to the first patch antenna pattern;

a second patch antenna pattern disposed in the second dielectric layer and configured to transmit/receive a second signal having a second frequency higher than the first frequency, the second patch antenna pattern overlapping at least a portion of the first patch antenna pattern in a propagation direction;

a second feed via coupled to the second patch antenna pattern; and shielding vias coupled to the second patch antenna pattern, wherein a size of the first patch antenna pattern is smaller than a size of the second patch antenna pattern, and wherein all of the shielding vias are disposed more adjacent to the first feed via than the second feed via.

17. An antenna apparatus comprising:

a first dielectric layer having a first dielectric constant;

a first patch antenna pattern disposed in the first dielectric layer;

a second dielectric layer having a second dielectric constant;

a second patch antenna pattern disposed on the second dielectric layer;

a first feed via coupled to the first patch antenna pattern;

a second feed via coupled to the second patch antenna pattern; and shielding vias coupled to the second patch antenna pattern, wherein the first dielectric constant is higher than the second dielectric constant, wherein a frequency of a signal transmitted/received by the first patch antenna pattern is lower than a frequency of a signal transmitted/received by the second patch antenna pattern, wherein the second feed via is disposed within the second dielectric layer, wherein the second patch antenna pattern has a through-hole, and the first feed via is disposed within the first dielectric layer and penetrates the through-hole, and wherein all of the shielding vias are disposed more adjacent to the first feed via than the second feed via.

* * * * *